US008080758B2

(12) United States Patent
Rosenbaum

(10) Patent No.: US 8,080,758 B2
(45) Date of Patent: Dec. 20, 2011

(54) METHOD FOR SORTING OBJECT, AND SORTING PLANT FOR CARRYING OUT SAID METHOD

(75) Inventor: Walter Rosenbaum, Paris (FR)

(73) Assignee: Siemens Aktiengesellschaft, Munich (DE)

( * ) Notice: Subject to any disclaimer, the term of this patent is extended or adjusted under 35 U.S.C. 154(b) by 121 days.

(21) Appl. No.: 11/989,343

(22) PCT Filed: Aug. 1, 2006

(86) PCT No.: PCT/EP2006/064888

§ 371 (c)(1),
(2), (4) Date: May 13, 2009

(87) PCT Pub. No.: WO2007/017412

PCT Pub. Date: Feb. 15, 2007

(65) Prior Publication Data

US 2009/0294250 A1 Dec. 3, 2009

(30) Foreign Application Priority Data

Aug. 5, 2005 (DE) ..... 10 2005 036 961

(51) Int. Cl.
*B07C 3/00* (2006.01)

(52) U.S. Cl. ..... 209/584; 209/900

(58) Field of Classification Search ..... 198/349, 198/443, 444, 572; 209/521, 546, 584, 651, 209/655, 657, 900; 414/927, 928, 929
See application file for complete search history.

(56) References Cited

U.S. PATENT DOCUMENTS

| | | | | |
|---|---|---|---|---|
| 5,695,071 | A | 12/1997 | Ross et al. | |
| 6,478,138 | B1 | 11/2002 | Edwards et al. | |
| 6,561,339 | B1 * | 5/2003 | Olson et al. | 198/349 |
| 6,846,153 | B2 | 1/2005 | Schiesser et al. | |
| 6,897,395 | B2 * | 5/2005 | Shiibashi et al. | 209/584 |
| 6,953,906 | B2 * | 10/2005 | Burns et al. | 209/584 |
| 7,012,211 | B2 * | 3/2006 | Brinkley et al. | 209/584 |
| 7,156,220 | B2 * | 1/2007 | Olson et al. | 198/465.1 |
| 7,170,024 | B2 * | 1/2007 | Burns et al. | 209/584 |
| 7,304,260 | B2 * | 12/2007 | Boller et al. | 209/584 |
| 7,329,824 | B2 * | 2/2008 | Chamblee et al. | 209/584 |
| 7,378,610 | B2 * | 5/2008 | Umezawa et al. | 209/584 |
| 7,442,896 | B2 * | 10/2008 | Ehrat et al. | 209/584 |
| 7,589,294 | B2 * | 9/2009 | Burns et al. | 209/584 |
| 7,669,706 | B2 * | 3/2010 | McLaughlin et al. | 198/349 |
| 2002/0125177 | A1 | 9/2002 | Burns et al. | |
| 2002/0131856 | A1 | 9/2002 | Schiesser et al. | |
| 2004/0016623 | A1 | 1/2004 | Olson et al. | |
| 2004/0074561 | A1 | 4/2004 | Boller et al. | |
| 2005/0002772 | A1 | 1/2005 | Stone | |

FOREIGN PATENT DOCUMENTS

EP 0 811 567 B1 8/1999

* cited by examiner

*Primary Examiner* — Douglas Hess
(74) *Attorney, Agent, or Firm* — Laurence A. Green; Werner H. Stemer; Ralph E. Locher

(57) ABSTRACT

To sort objects, an object is transferred onto a transport device of a sorting plant, and conveyed in accordance with predetermined sort criteria from the transport device to one of a number of outputs of the sorting plant. At the output, the object is transferred to a receptacle assigned to the output. A receptacle is removed from the output as soon as a predetermined fill level has been reached, or no further objects are delivered to the output. An empty receptacle is replaced for the removed receptacle. The empty receptacle is directed via the transport device to the output.

15 Claims, 1 Drawing Sheet

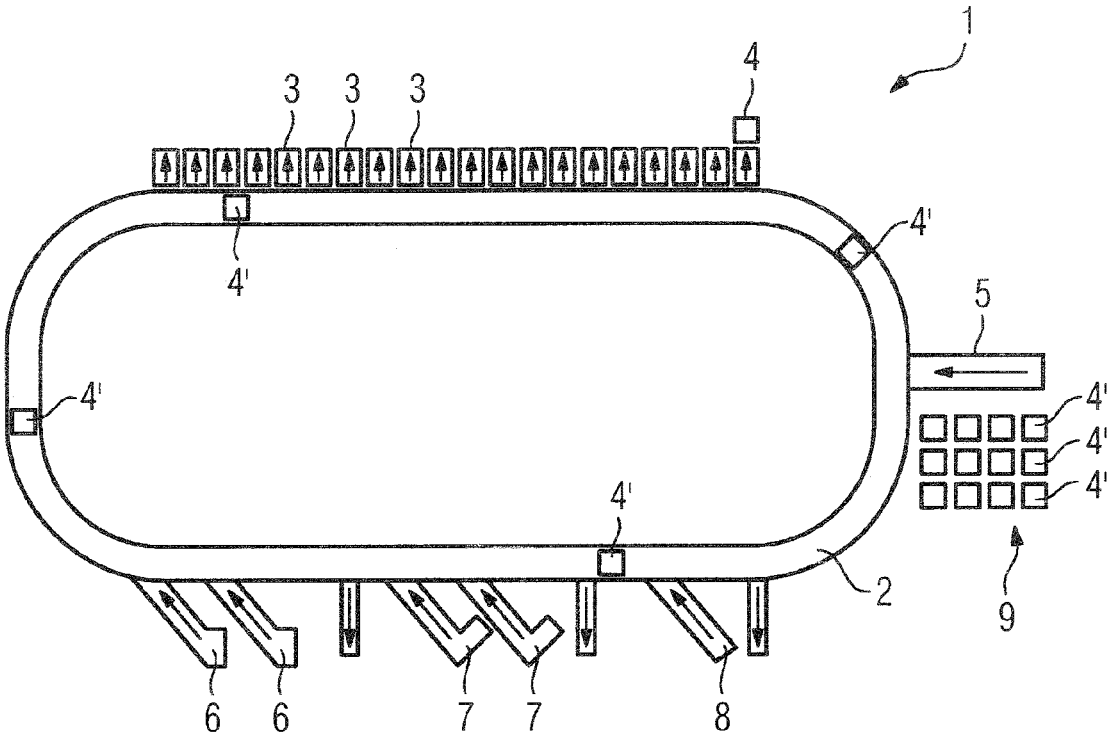
1
3
3
3
4
4'
4'
4'
5
4'
4'
4'
4'
4'
2
9
6
6
7
7
8

METHOD FOR SORTING OBJECT, AND SORTING PLANT FOR CARRYING OUT SAID METHOD

CROSS-REFERENCE TO RELATED APPLICATIONS

The present application is a national stage application of International Application No. PCT/EP2006/064888, filed on Aug. 1, 2006, which claims priority to German Patent Application No. 10 2005 036 961.8, filed on Aug. 5, 2005, both of which are incorporated herein by reference.

BACKGROUND OF THE INVENTION

The invention relates to a method for sorting objects, especially pieces of mail, as well as to a sorting plant.

If objects have to be sorted in large numbers, as is especially the case with pieces of mail the form of packets, flats (periodicals, brochures etc.) or bundles, then devices are frequently employed for this purpose which are largely mechanized and automated, so that manual activities only remain to be carried out at specific points. The sorting plants feature a transport device on which the output objects to be sorted are conveyed according to predetermined sort criteria (especially address) by means of a transport device to one of a number of outputs of the sorting plant. At least one container is positioned at the respective output which accepts the object routed to this location and where necessary also collects further objects with the same sort criteria. At the end of a sorting process, or if during a sorting process a container has already reached a correspondingly high fill level, this container is transported away in each case and immediately replaced by an empty container, so that the sorting process can be continued or a new sorting process can be started. The completely or partly filled container can of course be taken away manually but also by means of automated conveyor systems. The provision of new containers can obviously also be undertaken manually. It is usual however to provide a special conveyor device in each case for delivering the containers to the outputs of the sorting plant to their placement positions, which has a corresponding space requirement and demands a not inconsiderable investment outlay.

Basically simple linear conveyor runs with switches or also plows for the individual outputs can be used as a sorting plant. However sorters, which are embodied for example as tilt tray sorters or especially as crossbelt sorters, are normally used as sorting plants. Corresponding plants are for example known from U.S. Pat. No. 6,478,138 B1, EP 0 811 567 B1 or U.S. Pat. No. 6,662,20. Such sorting plants mostly feature an endless transport device circulating in a horizontal plane for the items to be sorted. This means that an object once injected can also circulate repeatedly if necessary. However there are also sorters which have a circulating transport device, but this device runs in a vertical plane, so that a transport of objects is only possible in the horizontal sections of the circuit. To this extent such a plant behaves like a linear conveyor run with corresponding switches or plows for sorting objects. A sorting plant for letters which are sorted into mail containers is known from U.S. Pat. No. 6,561,339 B1. This plant features an automatic conveyor system fully independent from the transport system for the delivery of empty mail containers and for the removal of filled mail containers.

A device for removal of individual mail containers from a stack of mail containers stacked above one another is known from U.S. Pat. No. 6,846,153 B2.

Finally US 2005/0002772 A1 deals with a handling system for mail containers.

SUMMARY OF THE INVENTION

The object of the present invention is to develop a method and a device of the generic type to the extent where the manual and also the engineering effort for the delivery of empty receptacles to the outputs of a sorting plant is as low as possible.

The core of the present invention is to be seen as simultaneously using the transport device for the objects to be sorted on a sorting system on which the generic method is executed for delivery of the empty receptacles to the outputs, at which a receptacle completely or partly filled with objects is or has been conveyed away. This means that the empty receptacle delivery facility is a functional component of the transport device for the objects to be sorted. The need for separate output conveyor devices for the delivery of receptacles, as are usually present in today's sorting plants, is thus dispensed with by the present invention. This reduces the investment outlay accordingly, without any increased manual effort having to be made to compensate.

Preferably the sorting is undertaken by means of an endless recirculating sorting device, or in more precise terms by an endless recirculating transport facility of the sorting plant, in which the transported objects or empty receptacles can if necessary undertake multiple circuits. It is advantageous for there regularly to be one or more empty receptacles circulating on the sorting device. In this case this means that an empty receptacle can be provided again very rapidly at an output at which a completely or partly filled receptacle is conveyed away. It must merely be ensured that, in the time between the conveying away of the filled receptacle and the placement of the empty receptacle, no objects to be sorted reach this output.

The delivery of the empty receptacles can expediently be carried out so that the receptacle will be output via the transport device of the sorting plant directly to the output at which the empty container is to be positioned. Alternatively however it is also possible to dispense with the ability to configure every output so that it is possible to transport an empty receptacle through said output. In such a case a group of respective outputs is formed of which only one is configured for the transport of empty receptacles. The other outputs of this group should then obviously where possible be in the immediate vicinity of this one output, so that for example empty receptacles can be picked up by an operator and can be positioned at neighboring outputs where they might be needed in each case.

The empty receptacles are expediently kept in an empty receptacle store and conveyed from this via an empty receptacle conveyor to the transport device of the sorting plant. The empty receptacle delivery facility thus consists in this case, starting from the empty receptacle store, of this empty receptacle conveyor and the transport device of the sorting plant which is present in any event. The latter advantageously features in the known manner separate injection points for packages and/or flats and/or bundles.

Even if the transport device of the sorting plant can be embodied as a linear conveyor of which the outputs can be controlled via switches or plows, it is preferable within the framework of the present invention to embody the transport device as a sorter, and to embody it as a sorter with an endlessly circulating conveying option for the objects and empty receptacles injected in each case. In respect of the technical design of such a sorter the basic technology which can be employed is that of a tilt tray sorter; preferably however crossbelt sorters are used.

The outputs of the sorting plant are expediently embodied as slides. These can also involve double slides, of which the conveyor path can optionally be controlled by switches, so that the output can be split onto two suboutputs, each with a separate receptacle for the objects to be sorted. Naturally it is basically also possible to provide more than two suboutputs and receptacles.

It is recommended that an electronic control be provided for the control of the entire plant which features a software program which is configured to temporarily interrupt the delivery of further objects to an output if a receptacle at this output is sufficiently filled and then to instigate the conveying away of this receptacle and the possible immediate delivery of one of the circulating empty receptacles.

BRIEF DESCRIPTION OF THE SEVERAL VIEWS OF THE DRAWINGS

The invention is explained in greater detail below with reference to an exemplary embodiment of a sorting plant shown schematically in the single FIGURE.

DETAILED DESCRIPTION OF THE INVENTION

The present invention involves a sorting plant 1 in which the transport device 2 for the objects to be sorted (not shown) has an enclosed circulation in a horizontal plane. This endless circulation is in the present case essentially embodied in the shape of a stadium but can have any other enclosed form. On one of the two long sides of the circuit of the transport device 2 are located a number of injection points for the objects to be sorted. These injection points differ depending on the type of these objects. In the present case this involves two injection points 6 for packages, two injection points 7 for flats and one injection point 8 for bundles.

On the long side of the circuit of the transport device 2 lying opposite the injection points 6, 7, 8 there is series of outputs 3, which are preferably embodied in the form of slides. A receptacle 4 is positioned on the output side of each slide, with only one such receptacle being depicted however in the schematic diagram. Objects not shown in the diagram injected at the injection points 6, 7, 8 are accepted into this receptacle 4 in accordance with the predetermined sort criteria and conveyed away. As soon as a completely or partly filled receptacle 4 is conveyed away from an output it is replaced by an empty receptacle 4' of which for example a number (in the present case four empty receptacles 4' are shown) are on the transport device circuit at the same time. The empty receptacles 4' are taken out of the receptacle store 9 and delivered via an empty receptacle conveyor 5 to the transport device 2. Since a number of receptacles are in circulation at the same time, a conveyed-away filled container can be replaced very rapidly by an empty container. This means that the time required for transport from the receptacle store to the relevant deployment position does not have to be expended, since in the arrangement shown an empty receptacle is always located just in front of the intended deployment position at the respective exit 3.

The present invention achieves the given object with extremely simple means since it restricts itself in practice to the modified use of parts of the sorting plant which are present in any event. The transport device used for transport of objects to be sorted is merely used in addition for the transport and the provision of empty receptacles at the respective point of deployment. A supply of empty receptacles is thus ensured practically without any extra plant outlay, with an immediate-replacement of a conveyed-away full receptacle being guaranteed.

The invention claimed is:

1. A method of sorting objects, comprising:

transferring an object onto a transport device of a sorting plant;

conveying the object in accordance with predetermined sort criteria from the transport device to one of a number of outputs of the sorting plant;

transferring the object at the output to a receptacle assigned to the output;

removing a receptacle from the output as soon as a predetermined fill level has been reached, or no further objects are delivered to the output; and replacing an empty receptacle for the removed receptacle, wherein the empty receptacle is directed via the transport device to the output.

2. The method of claim 1, wherein the sorting is carried out by means of an endless circulating sorting device, and one or more empty receptacles are regularly circulating on the sorting device.

3. The method of claim 1, wherein an empty receptacle is delivered in each case to precisely the output at which the filled receptacle has been removed.

4. A plant for sorting objects, comprising:

a transport device configured for transporting the objects, the transport device having at least one injection point for the objects and a number of outputs, each output being configured for a transfer of a sorted object to a receptacle; and a delivery facility for delivering empty receptacles to an output for replacing a filled receptacle with an empty receptacle, the delivery facility being functionally part of the transport device, at least one of the outputs being configured for outputting the empty receptacles therethrough.

5. The sorting plant of claim 4, further comprising an empty receptacle store for empty receptacles and an empty receptacle conveyor, with which empty receptacles from the empty receptacle store are able to be injected onto the transport device of the sorting plant.

6. The sorting plant of claim 5, wherein the outputs are embodied as slides.

7. The sorting plant of claim 5, wherein the outputs are combined into groups and one output of a group is configured for the output of empty receptacles for the remaining outputs of this group.

8. The sorting plant of claim 5, wherein all outputs are configured for the output of empty receptacles.

9. The sorting plant of claim 5, wherein separate injection points are provided for at least one of packages, flats and bundles.

10. The sorting plant of claim 5, wherein the transport device is embodied as a sorter.

11. The sorting plant of claim 10, wherein the sorter is embodied as a transport device which conveys the objects and empty receptacles injected in each case in an endless circuit.

12. The sorting plant of claim 11, wherein the sorter is a tilt tray sorter.

13. The sorting plant of claim 11, wherein the sorter is a crossbelt sorter.

14. The sorting plant of claim 5, wherein the transport device is a linear conveyor run having outputs that are controllable via switches and plows.

15. A plant for sorting objects, comprising:

a transport device configured for transporting the objects, said transport device being an object conveyor for conveying the objects, said transport device having at least one injection point for the objects and a number of outputs, each said output being configured for a transfer of a sorted object to a receptacle; and an empty receptacle conveyor configured for injecting the receptacles onto said object conveyor.

* * * * *